US005202732A

United States Patent [19]

Yahata

[11] Patent Number: 5,202,732

[45] Date of Patent: Apr. 13, 1993

[54] DEVELOPING DEVICE FOR IMAGE FORMING EQUIPMENT

[75] Inventor: Masasumi Yahata, Yokohama, Japan

[73] Assignee: Ricoh Company, Ltd., Tokyo, Japan

[21] Appl. No.: 834,202

[22] Filed: Feb. 12, 1992

[30] Foreign Application Priority Data

Feb. 15, 1991 [JP] Japan ..... 3-21958

[51] Int. Cl.[5] ..... G03G 15/08

[52] U.S. Cl. ..... 355/260; 355/245; 355/251; 118/653

[58] Field of Search ..... 355/260, 245, 251, 253, 355/246, 259; 118/658, 656, 657, 651, 653, 661

[56] References Cited

U.S. PATENT DOCUMENTS

| | | | |
|---|---|---|---|
| 4,481,903 | 11/1984 | Haberhauer et al. | 118/658 X |
| 4,633,807 | 1/1987 | Jacobs | 118/657 |
| 4,748,471 | 5/1988 | Adkins | 118/657 X |
| 5,005,516 | 4/1991 | Speer | 118/657 |
| 5,036,358 | 7/1991 | Yoshida | 355/245 X |
| 5,060,021 | 10/1991 | Yamamoto et al. | 355/245 |

FOREIGN PATENT DOCUMENTS

| | | | |
|---|---|---|---|
| 0330225 | 8/1989 | European Pat. Off. | 355/260 |
| 0216270 | 12/1983 | Japan | 355/260 |
| 0213877 | 9/1988 | Japan | 355/260 |

*Primary Examiner*—A. T. Grimley
*Assistant Examiner*—T. A. Dang
*Attorney, Agent, or Firm*—Oblon, Spivak, McClelland, Maier & Neustadt

[57] ABSTRACT

A developing device incorporated in image forming equipment and having a toner tank made up of a tank portion and a toner supply portion contiguous with one side of the tank portion for supplying the toner from the tank portion to a developing section which includes a developing roller. The tank portion accommodates a bladed wheel having blades therein while the toner supply portion has a projection which protrudes into the radius of rotation of the blades. As the blades are rotated, the projection scrapes off the toner deposited on the blades to thereby feed it into the toner supply portion. The radius of rotation of the blades is substantially equal to or smaller than the inner radius of the tank portion, whereby the blades are prevented from pressing against the tank portion.

14 Claims, 5 Drawing Sheets

DEVELOPING DEVICE FOR IMAGE FORMING EQUIPMENT

BACKGROUND OF THE INVENTION

The present invention relates to a developing device for image forming equipment and, more particularly, to a developing device of the type having a toner tank made up of a tank portion storing a toner and a toner supply portion contiguous with one side of the tank portion for supplying the toner from the tank portion to a developing section which includes a developing roller.

A developing device of the type described is conventional and incorporated in an electrophotographic copier, facsimile transceiver, laser printer or similar image forming equipment. Generally, to promote easy toner supply from a toner tank to a developing section, the toner tank should preferably be disposed above the developing section in which a developing roller is located to face a photoconductive element. In practice, however, the toner tank and developing section often have to be arranged such that their bottoms are positioned at the same level or height for space and design reasons. Even with such an arrangement, it is necessary to supply the toner from above the developing section and, for this purpose, a toner supply portion of the tank is usually located at one side of and above a tank portion of the tank. An agitator is disposed in the tank portion and rotated to sweep up the toner from the tank portion to the toner supply portion. The agitator is rotated while urging itself against the inner periphery of the tank portion due to the elasticity of an elastic member affixed to the end of the agitator. The agitator is, therefore, subjected to the resistance of the toner. This brings about a problem that since a shaft on which the agitator is mounted needs an extremely great torque when a great amount of toner exists in the tank portion. Moreover, when a projection provided in the toner supply portion for catching the toner swept up by the agitator is located at a higher level than the shaft, the conveying force acting on the toner sharply decreases at the position of the projection. It follows that the position of the toner supply portion is somewhat limited to in turn limit the design freedom of the image forming equipment.

SUMMARY OF THE INVENTION

It is, therefore, an object of the present invention to provide a developing device for image forming equipment which allows the toner supply portion of a toner tank to be located at any desired level and reduces the torque necessary for a toner to be conveyed from a tank portion to a developing section which has a developing roller therein.

In accordance with the present invention, a developing device incorporated in image forming equipment and having a toner tank storing a toner and a developing section connected to the toner tank for receiving the toner therefrom via a toner supply portion has a bladed wheel disposed in the toner tank and having a rotary shaft, support members affixed to the shaft, and a blade constituted by an elastic member supported by the support members. The bladed wheel rotates the blade for feeding the toner from the toner tank to the toner supply portion. A projection is located at an upstream position in an intended direction of toner feed from the toner tank to the toner supply portion in such a manner as to protrude into the radius of rotation of the blade.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 9:
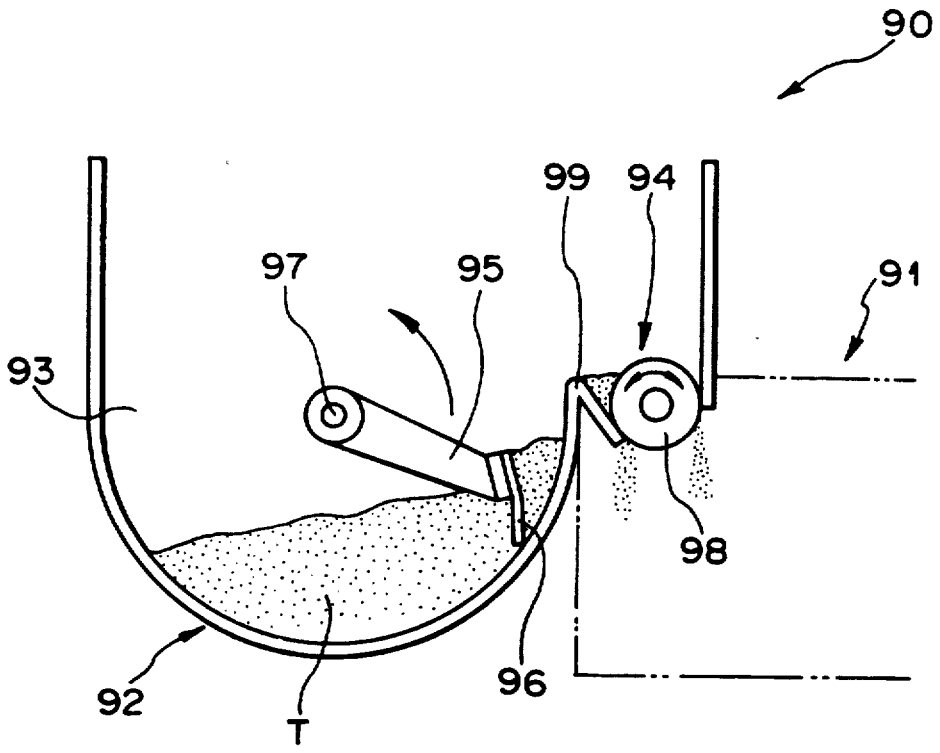
Fig. 9 PRIOR ART
FIG. 9 is a section showing a conventional developing device for image forming equipment.

To better understand the present invention, a brief reference will be made to a prior art developing device, shown in FIG. 9. As shown, the developing device, generally 90, has a developing section 91 including a developing roller, not shown, and a toner tank 92 connected to the developing section 91. The toner tank 92 is made up of a tank portion 93 storing a toner T therein and a toner supply portion 94 contiguous with one side of the tank portion 93. An agitator 95 is disposed in the tank portion 93 and rotatably mounted on a shaft 97. An elastic member 96 is affixed to the free end of the agitator 95. The toner supply portion 94 has a toner supply roller 98 and a projection 99. The toner tank 92 and developing section 91 are positioned such that their bottoms assume substantially the same level. As the agitator 95 disposed in the tank portion 93 is rotated in a direction indicated by an arrow in the figure, the elastic member 96 sweeps up the toner T to thereby convey it to the toner supply portion 94. The toner supply roller 98 located in the toner supply portion 94 is rotated to supply the toner T further to the developing roller disposed in the developing section 91.

In the above construction, the agitator 95 is rotated while urging itself against the inner periphery of the tank portion 93 due to the elasticity of the elastic member 06. The agitator 98 is, therefore, subjected to the resistance of the toner T. This is undesirable since the shaft 97 needs an extremely great torque when a great amount of toner exists in the tank potion 93, as discussed earlier. Moreover, since the projection 99 provided in the toner supply portion 94 for catching the toner T is located at a higher level than the shaft 97 of the agitator 95, the conveying force acting on the toner T sharply decreases at the position of the projection 99. It follows that the position of the toner supply portion 94 is somewhat limited to in turn limit the design freedom of the image forming equipment.

Referring to FIGS. 1-4, a developing device embodying the present invention is shown and generally designated by the reference numeral 10. As shown, the developing device 10 has a toner tank 11 storing a toner T therein and a developing section 12. A developing roller, not shown, is accommodated in the developing section 12 and located to face a photoconductive element, not shown. The toner tank 11 and developing section 12 have their bottoms positioned at the same level or height for the space and design reasons. The toner tank 11 has a tank portion 13 storing the toner T and a toner supply portion 14 contiguous with one side of the tank portion 13. The toner is fed from the toner supply portion 14 to the developing section 12. A bladed wheel assembly 15 is accommodated in the tank portion 3 and rotatably mounted on a shaft 16. A toner supply roller 17 is disposed in the toner supply portion 14 for supplying the toner to the developing section 12. A projection 18 which will be described later specifically is provided in the toner supply portion 14.

Figure 1:
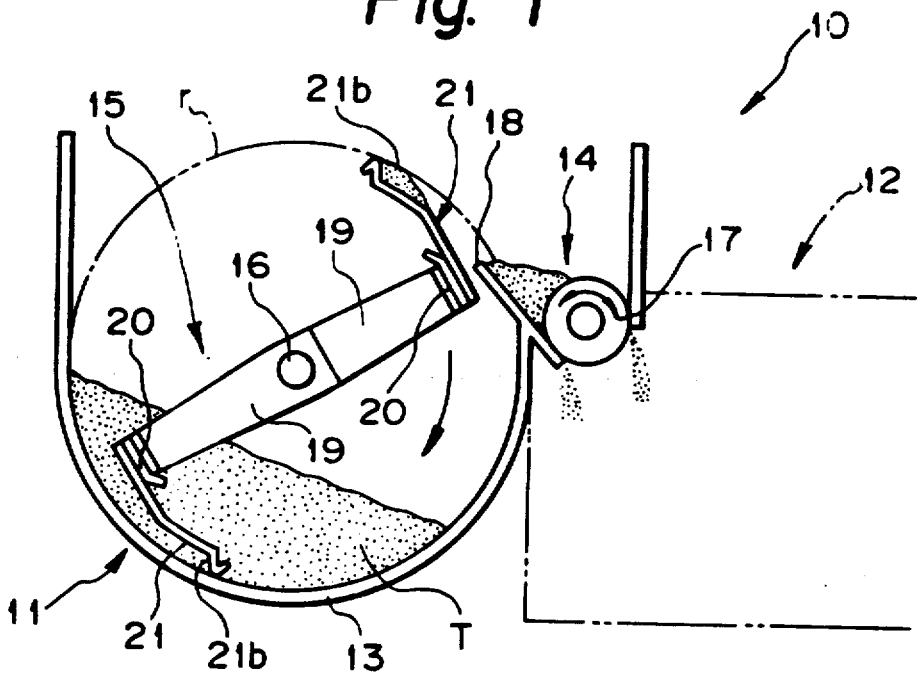
FIG. 1 is a section of a developing device for image forming equipment emboying the present invention.
Figure 2:
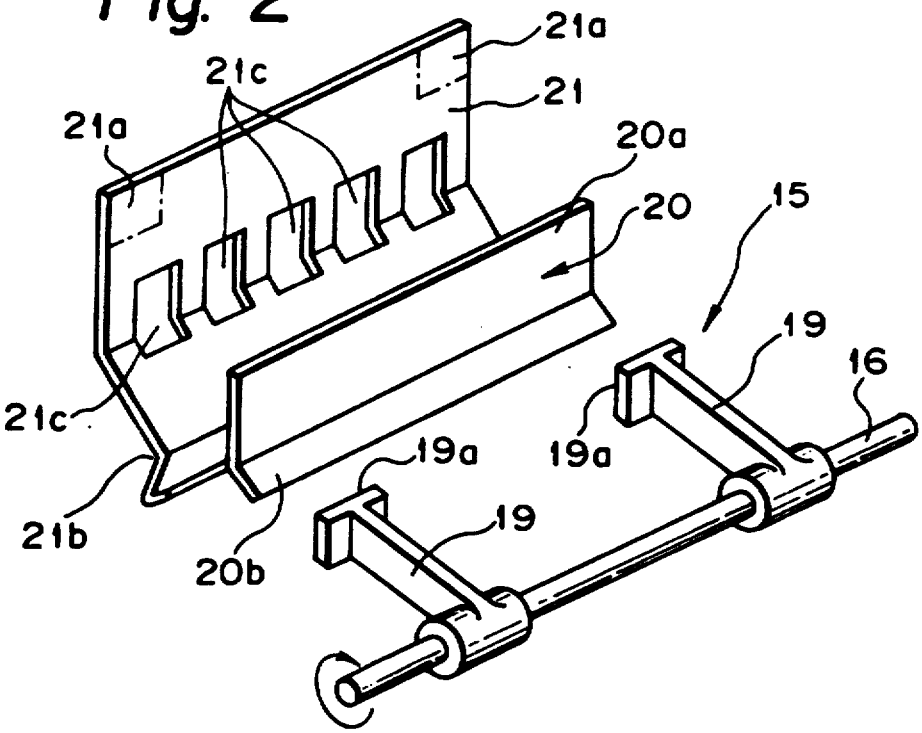
FIG. 2 is an exploded perspective view of a bladed wheel assembly disposed in a tank portion forming part of a toner tank included in the embodiment.

As shown in FIGS. 1 and 2, the bladed wheel assembly 15 rotatably mounted on the shaft 16 is made up of a pair of support members 19 affixed to the shaft 16, a reinforcing plate 20 affixed to the free ends of the support members 19, and an elastic blade 21 affixed to the reinforcing plate 20. Each support member 19 has an end face 19*a* which is affixed to the surface of the reinforcing plate 20 by, for example, adhesive. The reinforcing plate 20 has a connecting portion 20*a* substantially parallel to a line tangential to the radius of rotation $\gamma$ of the blade 21, and an agitating portion 20*b* extending out from the connecting portion 20*a* and bent toward the shaft 16. The end faces 19*a* of the support members 19 are adhered or otherwise affixed to the inner surface of the connecting portion 20*a* of the reinforcing plate 20 that faces the shaft 16. The blade 21 is adhered to the other or outer surface of the connecting portion 20*a* of the reinforcing plate 20 at the portions 21 thereof which are indicated by dash-and-dot lines in FIG. 2. The blade 21 has a greater width than the reinforcing plate 20 in the direction of rotation of the blade 21. Since the leading edges of the blade 21 and reinforcing plate 20 with respect to the direction of rotation are substantially aligned with each other, the blade 21 extends out from the reinforcing plate 20 to the rear. The blade 21 has a recess 21*b* at the trailing end thereof for receiving the toner T. Openings 21*c* are formed through substantially the intermediate portion of the blade 21. Although the blade 21 has a radius of rotation $\gamma$ substantially identical with the inside radius of the tank 13, it simply trails on the inner periphery of the tank 13 and does not press itself against the latter.

In the illustrative embodiment, the shaft 16 is rotated at a speed of 10 to 20 r.p.m. The support members 19 and reinforcing member 20 are made of a highly rigid material. The blade 21 is 0.1 to 0.2 mm thick and made of phosphor bronze. While the bladed wheel assembly 15 is shown as having two groups of support members 19, reinforcing plate 20 and blade 21 which are spaced apart by an angle of 180 degrees, three or more groups of support member 19, reinforcing plate 20 and blade 21 may be mounted on the shaft 16.

Figure 3:
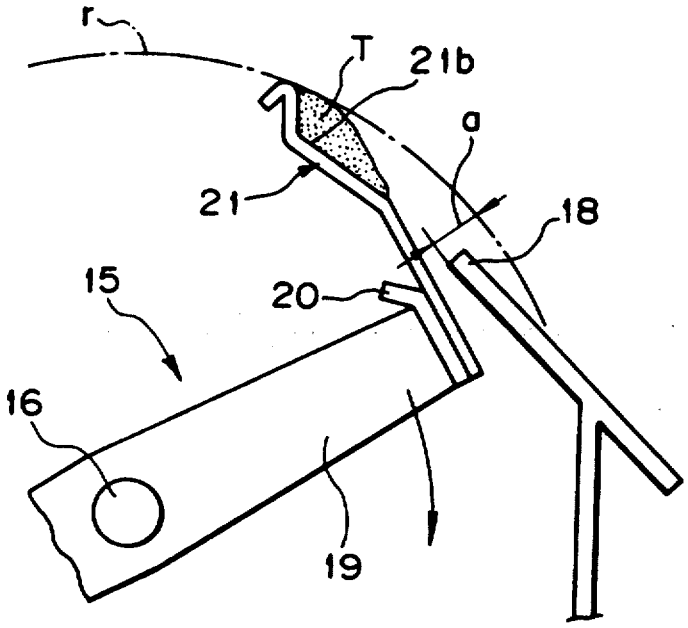
FIGS. 3 and 4 are sections demonstrating the operation of the bladed wheel assembly shown in FIG. 2.

As shown in FIG. 3, the projection 18 included in the toner supply portion 14 protrudes into the radius of rotation $\gamma$ by a dimension $\alpha$ which allows the blade 21 to rub against the projection 18.

Figure 4:
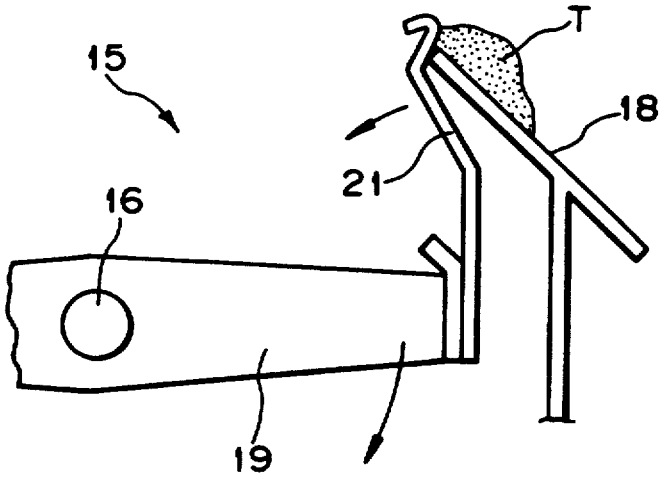
Figure 5:
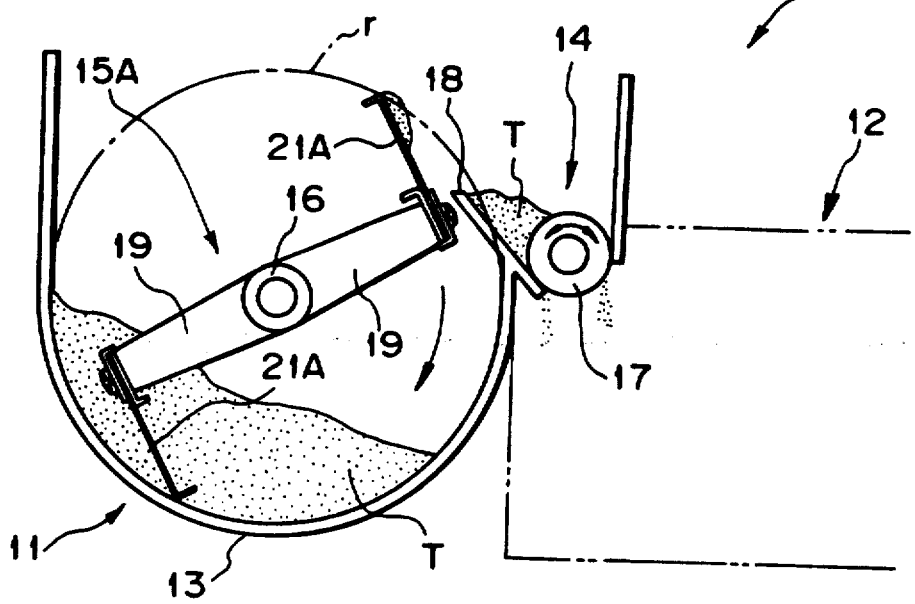
FIG. 5 is a section showing an alternative embodiment of the present invention.
Figure 6:
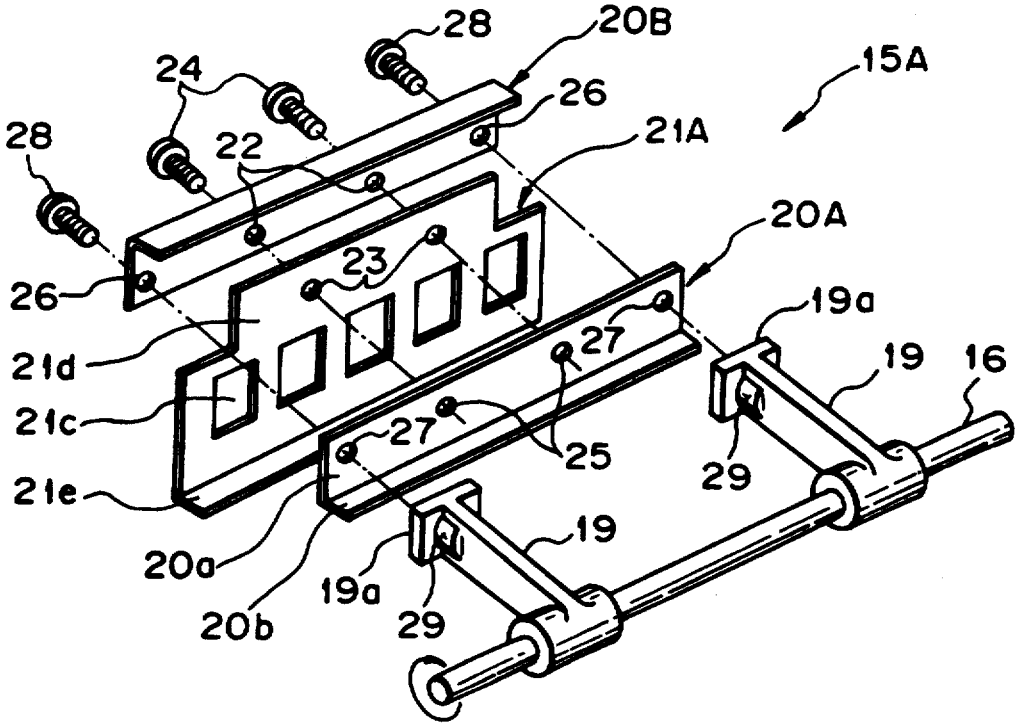
FIG. 6 is an exploded perspective view of a bladed wheel assembly included in the embodiment shown in FIG. 5.
Figure 7:
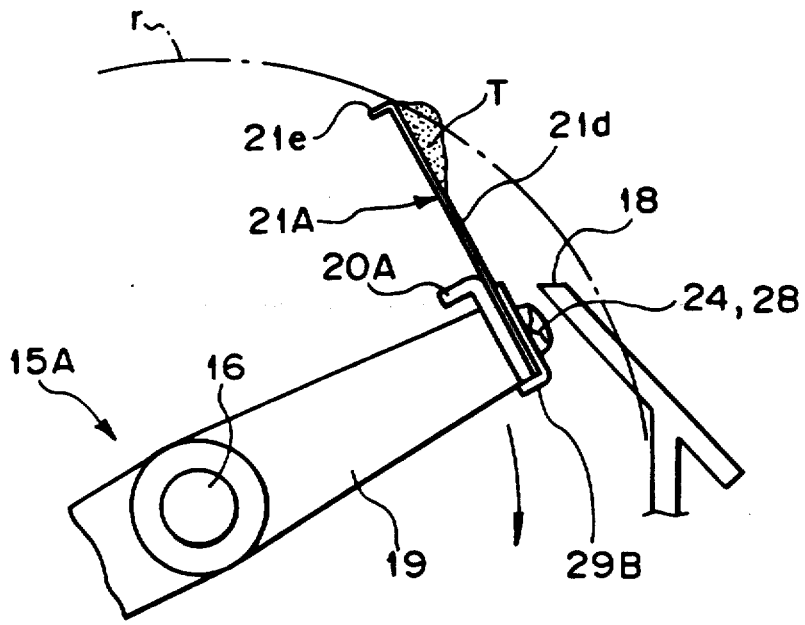
FIGS. 7 and 8 are sections demonstrating the operation of the bladed wheel assembly shown in FIG. 6.

In operation, as the shaft 16 is rotated, each blade 21 of the bladed wheel assembly 15 rotates in such a manner as to pass the projection 18 downward. The blade 21, therefore, contacts the toner T in the tank portion 13 and allows it to deposit thereon while collecting the toner T in the recess 21*b*. When the blade 21 carrying the toner T thereon reaches the projection 18, it passes the projection 18 while rubbing thereagainst. At this instant, the projection 18 scraps off the toner T from the blade 21 with the result that the toner T is dropped into the toner supply portion 14, as shown in FIG. 4. While the reinforcing plate 20 made of a highly rigid material also rotates together with the shaft 16, the agitating portion 20*b* thereof moves in a direction for preventing the toner T from cohering since it is bent toward the shaft 16. Since the blades 21 are 0.1 to 0.2 mm thick and made of phosphor bronze, as stated previously, they have desirable elasticity and allow the toner to easily deposit thereon. Moreover, the blades 21 do not press themselves against the inner periphery of the tank portion 13. This, coupled with the fact that the resistance to bending is small even when the amount of toner in the tank portion 13 is great, reduces the torque necessary for the toner T to be conveyed. The openings 21*c* formed through the blades 21 further reduce the torque. It follows that only a small torque suffices the toner conveyance with no regard to the position of the toner supply portion 14 relative to the shaft 16, i.e., above or below the shaft 16.

The recess 21*b* formed at the trailing end of each blade 21 is not essential and may be omitted, if desired. The radius of rotation $\gamma$ of the blades 21 may be smaller than the inside radius of the tank portion 13. Further, the blades 21 and their associated support members 19 may be formed integrally with each other without the intermediary of the reinforcing plates 20.

Referring to FIGS. 5–8, an alternative embodiment of the present invention will be described. In FIGS. 5–8, the same or similar parts and elements to those shown in FIGS. 1–4 are designated by like reference numerals, and redundant description will be avoided for simplicity. As shown, the developing device, generally 10A, differs from the previous developing device 10 regarding the structure of the blades and reinforcing plates. Specifically, the developing device 10A includes blades 21A each having a flat portion 21*d* formed with openings 21*c*, and a bent portion 21*e* extending from the trailing end of the flat portion 21*d* and defining the radius of rotation $\gamma$. The bent portion 21*e* prevents the blade 21A from scratching or otherwise damaging the inner periphery of the tank portion 13 and projection 18 while in rotation. The blade 21A is reinforced by two reinforcing plates 20A and 20B. Specifically, after the reinforcing plates 20A and 20B have been laid on both sides of the flat portion 21*d* of the blade 21A, bolts 24 are driven into females screws 25 formed in the reinforcing plate 20A via holes 22 and 23 formed through the reinforcing plate 20B and blade 21B, respectively. As a result, the reinforcing plates 20A and 20B and blade 21A are fastened together. The resulting subassembly of the reinforcing plates 20A and 20B and blade 21A is fastened to the support members 19 by bolts 28 which are driven into female screws 29 formed in the end faces 19*a* of the support members 19 via holes 26 and 27 formed through the reinforcing plates 20B and 20A, respectively.

Figure 8:
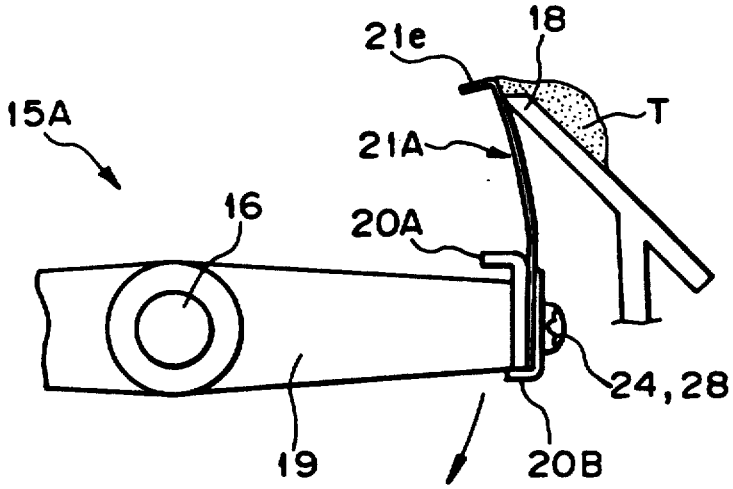

In operation, as the shaft 16 is rotated, each blade 21A of the bladed wheel assembly 15A rotates in such a manner as to pass the projection 18 downward. The blade 21A, therefore, contacts the toner T in the tank portion 13 and allows it to deposit on the surface of the flat portion 21*d*. When the blade 21A carrying the toner T thereon reaches the projection 18, it passes the projection 18 while rubbing thereagainst. At this instant, the projection 18 scrapes off the toner T from the blade 21A with the result that the toner T is dropped into the toner supply portion 14, as shown in FIG. 8.

In this embodiment, too, the reinforcing plates 20A and 20B are not essential and may be omitted, and three or more groups of support members 19, reinforcing plates 20A and 20B and blade 21A may be mounted on the shaft 16.

In summary, the present invention provides a developing device having a bladed wheel assembly disposed in a tank portion of a toner tank and including blades, and a projection positioned in a toner supply portion of the toner tank and protruding into the radius of rotation of the blades. As the blades are rotated, the projection scrapes off a toner from the blades and feeds it to the toner supply portion. This allows the toner supply portion to assume a higher level than a shaft on which the blades are rotatably mounted. Since the radius of rotation of the blades is substantially equal to or smaller than the radius of the inner periphery of the tank portion, the blades do not press against the inner periphery of the tank and, therefore, need only a small torque.

Various modifications will become possible for those skilled in the art after receiving the teachings of the present disclosure without departing from the scope thereof.

What is claimed is:

1. A developing device incorporated in image forming equipment and having a toner tank storing a toner and a developing section connected to said toner tank for receiving said toner from said toner tank via a toner supply portion, said device comprising:

bladed wheel means disposed in said toner tank and comprising a rotary shaft, support members affixed to said rotary shaft, and a blade constituted by an elastic member supported by said support members, said bladed wheel means rotating said blade for feeding the toner from said toner tank to said toner supply portion wherein the rotating of said blade causes said blade to travel along a path of movement with a radially outermost portion of said blade defining a radius of rotation, said path of movement extending through a supply of toner in said tank, said blade having a surface which collects a portion of toner thereon as said blade travels through the supply of toner; and a projection member located at an upstream position in an intended direction of toner feed from said toner tank to said toner supply portion, said projection member also located at a position along said path of movement of said blade which is downstream of said supply of toner such that said surface of said blade carries the portion of toner as said blade reaches the position of said projection member, said projection member at least partially protruding into the radius of rotation of said blade to remove the portion of toner from said surface of said blade and feed said portion of toner toward the toner supply portion of the image forming apparatus.

2. A device as claimed in claim 1, wherein said surface is a radially outwardly facing surface and wherein a recess is formed on the radially outwardly facing surface at a trailing end of said blade with respect to an intended direction of rotation of said blade for collecting the toner.

3. A device as claimed in claim 2, wherein a plurality of openings are formed through an intermediate portion of said blade.

4. A device as claimed in claim 1, wherein said support members and said blade are connected to each other by adhesive.

5. A device as claimed in claim 1, wherein said blade is 0.1 to 0.2 mm thick and made of phosphor bronze.

6. A device as claimed in claim 1, wherein said support members are made of a highly rigid material.

7. A device as claimed in claim 1, wherein said projection is located at a higher level than said rotary shaft.

8. A device as claimed in claim 1, further comprising a reinforcing member having a flat connecting portion and an agitating portion formed by bending one end of said connecting portion, said reinforcing member being held between and fastened to said support members and said blade for thereby reinforcing said blade.

9. A device as claimed in claim 8, wherein said blade has a greater width than said connecting portion of said reinforcing member in an intended direction of rotation of said blade.

10. A device as claimed in claim 8, wherein said reinforcing member is made of a rigid material.

11. A device as claimed in claim 1, wherein said blade of said bladed wheel means comprises a flat portion for agitating the toner, and a bent portion formed by bending one end of said flat portion.

12. A device as claimed in claim 11, wherein a plurality of openings are formed through an intermediate portion of said flat portion of said blade.

13. A device as claimed in claim 11, wherein said support members and said blade are fastened to each other by bolts.

14. A device as claimed in claim 11, further comprising two flat reinforcing members fastened to said blade while holding said blade therebetween and fastened to said support members.

* * * * *